United States Patent [19]

Frazer et al.

[11] 4,369,857

[45] Jan. 25, 1983

[54] LOUDSPEAKER AND HORN COMBINATION

[75] Inventors: Spencer Frazer; Steven P. Soibelman, both of Los Angeles, Calif.

[73] Assignee: The Kind Horn Company, Los Angeles, Calif.

[21] Appl. No.: 227,394

[22] Filed: Jan. 22, 1981

[51] Int. Cl.[3] ..... G10K 13/00

[52] U.S. Cl. ..... 181/159; 181/180; 181/187; 181/189; 181/192; 181/DIG. 1

[58] Field of Search ..... 181/150–153, 181/159, 160, 182, 183, 185, 187, 188, 192, 195, 196, DIG. 1, 180, 189; 179/115.5 H

[56] References Cited

U.S. PATENT DOCUMENTS 1,314,980 9/1919 Pogonowski ..... 181/192

3,642,091 2/1972 Nohara et al. ..... 181/152 X

FOREIGN PATENT DOCUMENTS 697869 11/1964 Canada ..... 181/DIG. 1

*Primary Examiner*—Benjamin R. Fuller

*Attorney, Agent, or Firm*—Edward D. O'Brian; K. H. Boswell

[57] ABSTRACT

A loudspeaker and horn combination having desirable sound clarity characteristics and having a desirable per unit of electric power input to per unit of sound output ratio can be constructed using a horn body of one or more parts of a rigid, closed cell polyurethane foam material having a smooth exterior skin or surface shaped so as to include an internal horn cavity. A speaker is located so that its diaphragm extends across an entrance end of the cavity. The cavity is shaped in a bilaterally symmetrical manner so as to include a sound chamber region adjacent to and leading from the speaker diaphragm, this sound chamber region having a restricted throat located intermediate its ends and having a continuous curvature between its ends, a flare region diverging outwardly from the end of the sound cavity region remote from the speaker and a transitional region located generally between the flare and sound cavity regions so as to connect the adjacent surfaces of these regions.

8 Claims, 5 Drawing Figures

FIG. 1.
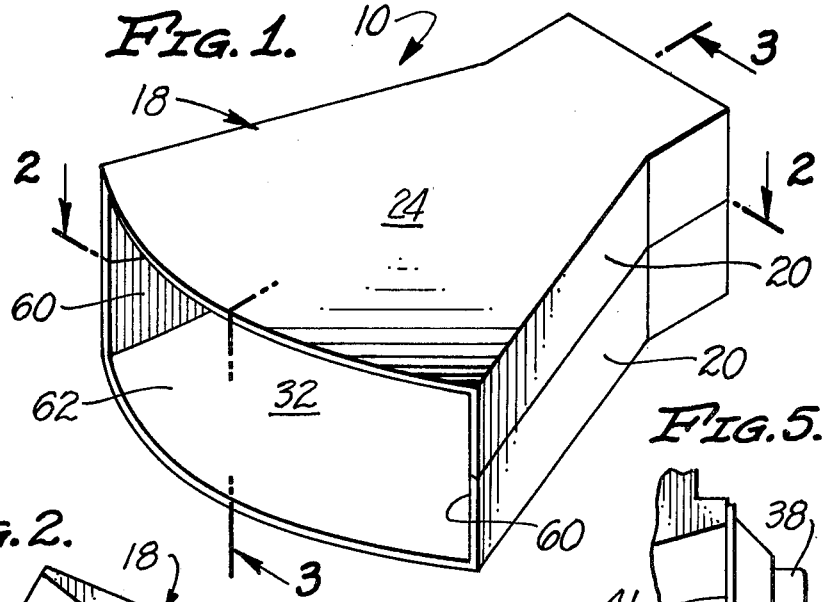
FIG. 5.
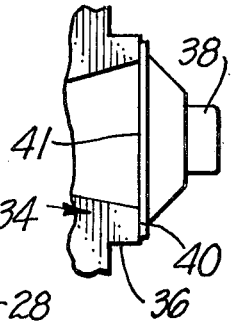
FIG. 2.
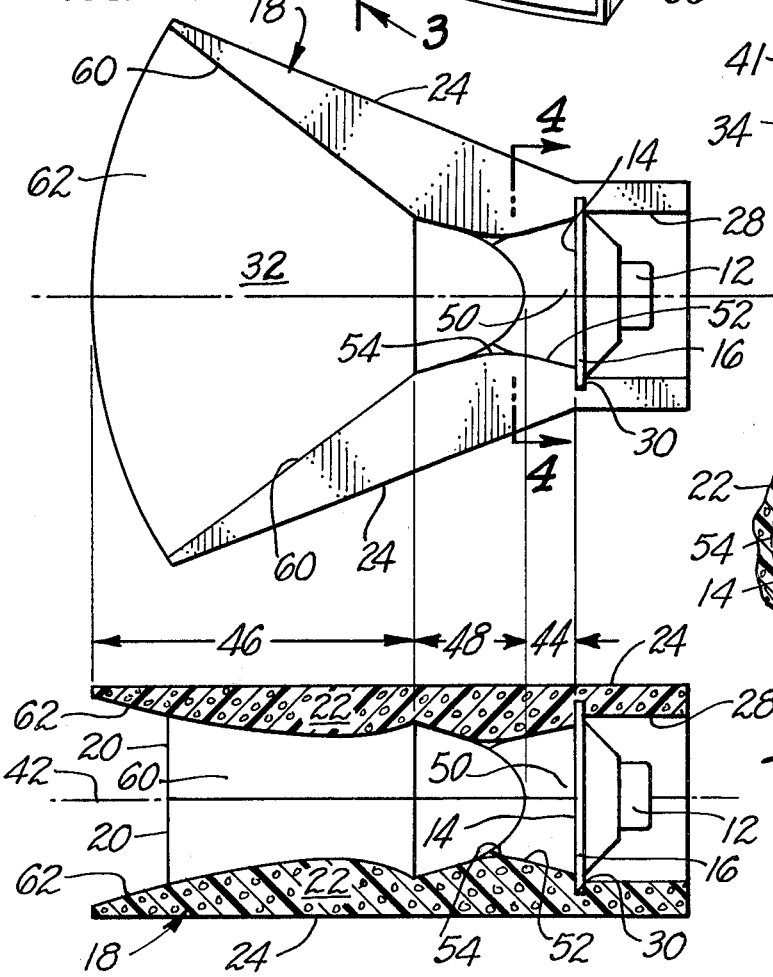
FIG. 4.
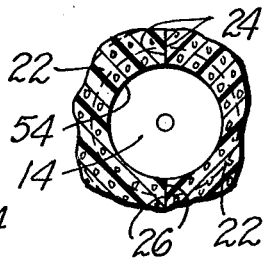
FIG. 3.

LOUDSPEAKER AND HORN COMBINATION

BACKGROUND OF THE INVENTION

The invention set forth in this specification relates to new and improved loudspeaker and horn structures and/or combinations. On occasion such structures or combinations are referred to as horn loudspeakers.

A wide variety of different so-called loudspeakers are, of course, used to convert electrical energy into sound or sound energy. It is considered that an understanding of the present invention does not require a detailed discussion of all of the various different types of loudspeakers which have been manufactured and used. Such speakers or loudspeakers are normally constructed so as to include a diaphragm of one known type or another which is physically moved directly or indirectly in response to an applied electric signal in order to move adjacent air so that sound is produced. For many years it has been recognized that the relative clarity of such sound can be improved by utilizing a so-called horn adjacent to such a diaphragm.

The horns previously used with speakers have been constructed in many different ways. In a sense, a horn is utilized to couple the sound produced at or about the surface of the diaphragm with the ambient air. In so doing an internal cavity within a horn which is open to the ambient air serves to reflect, direct and to some extent modify the pressure changes within the air constituting the sound so that the sound is directed outwardly from the speaker diaphragm into the ambient air. Depending upon how the horn is constructed, as this is accomplished some sound may be absorbed to a degree by the walls of the horn cavity and to a degree there may be some resonance set up as a result of the shape of the horn cavity and/or as a result of the material used in the horn.

These and various other factors not specifically enumerated are considered to effect the clarity of the sound characteristics resulting from the operation of a horn loudspeaker. These and such other factors are also considered to effect the amount of sound produced per unit of electric power used to drive the speaker. This ratio is considered important since it is normally desired to obtain as great an amount of sound per unit of electric power used as reasonably possible. This is important not only from an economic standpoint but also because many speakers do not operate in the intended manner when comparatively high levels of electric power are supplied to them.

In any horn loudspeaker the primary objective is always to obtain a sound of desirable characteristics, particularly sound which may be regarded as "clear" in the sense that it reasonably corresponds to a sound being reproduced through a loudspeaker. Thus, for example, when the sound of a specific musical instrument is reproduced through the loudspeaker the sound produced by the loudspeaker should be substantially the same as the sound originally produced by the instrument. The sound produced by a speaker or by a horn loudspeaker normally involves one or more sounds of intended frequencies plus a multitude of harmonic tones and a multitude of tones which cannot be reasonably classified, except, perhaps, with reference to the manner in which the original sound is produced.

One problem in any sort of a speaker or horn loudspeaker relates to the complexity of the sound which is obtained at any one time as, for example, an orchestra plays music. In practice the construction of horn loudspeakers which will accommodate and accurately reproduce a multitude of sounds throughout the entire range of sound frequencies capable of being received by the human ear is quite difficult. Because of the problems involved in reproducing a multitude of sounds with clarity, it has been conventional to use a plurality of horn loudspeakers in combination with one another, each horn loudspeaker so used being constructed to be primarily responsive to within a specific frequency range. While this type of expedient is desirable, it is believed that it is desirable to minimize the use of a number of horn loudspeakers together because of the cost of such horn loudspeakers.

From this discussion it is believed it will be apparent that a number of complex and interrelated factors are involved in connection with the construction and operation of loudspeaker and horn structures or horn loudspeakers. Although such devices or combinations are well known, it is believed that there exists a continuing need for new and improved horn loudspeakers having a desired degree of clarity which can be operated utilizing a comparatively minimal amount of electric power in order to produce a comparatively maximum amount or intensity of sound and which can achieve these results over a reasonably wide frequency range.

BRIEF SUMMARY OF THE INVENTION

A broad objective of the present invention is to fulfill the need briefly indicated in the preceding paragraph. Another objective of the present invention is to provide horn loudspeakers to fulfill this need which may be easily and conveniently manufactured at a comparatively nominal cost. A further objective of the present invention is to provide horns for use with loudspeakers which, although not of a preferred internal shape in accordance with this invention, are quite desirable for use with speakers because of the manner in which they are constructed.

The latter of these objectives is achieved by providing in the combination of a speaker mechanism and a horn structure for said speaker mechanism the improvement which comprises said horn comprising two sections, each of said sections having a contact surface, a speaker holding surface and a sound directing surface; said sections being located with said contact surfaces abutting against one another, said speaker holding surface being located with respect to one another so as to define a speaker holding cavity surrounding and engaging said speaker mechanism, said sound directing surfaces being located with respect to one another so as to define a speaker horn interior leading from said cavity and said speaker mechanism.

The former of these objectives is preferably achieved by providing a horn loudspeaker system including a speaker having a diaphragm and a horn provided with an internal horn cavity, said cavity having an entrance and an exit, said horn being located so that said diaphragm is positioned so as to extend across said entrance to said cavity and so that said horn cavity extends outwardly away from said diaphragm in which the improvement comprises said horn cavity having a centrally located axis which is perpendicular to the center of said diaphragm and being bilaterally symmetrical about a plane passing through said axis; said horn cavity including a sound chamber region, a transitional region, and a flare region located so that said sound chamber region extends from said entrance toward the interior of said cavity and so that said flare region extends from within the interior of said cavity to said exit, said sound chamber and flare regions being separated by said transitional region; said sound chamber region including a throat extending transverse to said axis intermediate the ends thereof which is of lesser cross-sectional area than any other part of said sound chamber region and being defined by at least one wall having a continuous, smooth curvature extending between the ends of said sound chamber region; said flare region being defined by two substantially flat walls located at an angle with respect to one another and two curved walls extending between said flat walls, said walls of said flare region diverging outwardly away from said sound chamber region, said curved walls of said flare region having a gradually increasing curvature in accordance with the distance from said sound chamber region; said transitional region being shaped so as to provide a substantially smooth transition between the adjacent ends of said sound chamber region and said flare region; the cross-sectional areas of the adjacent ends of said sound chamber region and said flare region in planes transverse to said axis adjacent to said transitional region being substantially the same.

The horn in a horn loudspeaker system as indicated in the immediate preceding is preferably constructed utilizing two separate, connected sections, each of which is formed of a rigid, porous, foam material having an exterior skin. It is considered that such a porous, rigid, foam material possesses the ability to reflect and otherwise modify sound in a horn in various ways so that it can be used so as to obtain sound clarity reasonably corresponding to the nature of an original sound while concurrently the loudness of the sound emitted is comparatively greater per unit of electric power used to drive or operate the speaker.

BRIEF DESCRIPTION OF THE DRAWINGS

Because of the complex, yet in reality somewhat simple, nature of the present invention, it is best more fully explained with reference to the accompanying drawings in which:

FIG. 1 is a perspective view of a presently preferred embodiment or form of a horn loudspeaker or loudspeaker horn combination in accordance with this invention;

FIG. 2 is a cross-sectional view taken at line 2—2 of FIG. 1;

FIG. 3 is a cross-sectional view taken at line 3—3 of FIG. 1;

FIG. 4 is a partial cross-sectional view taken at line 4—4 of FIG. 2; and

FIG. 5 is a partial cross-sectional view corresponding to the right hand side of FIG. 2 indicating a modified method of mounting a speaker on a horn.

The particular loudspeaker horn combination or horn loudspeaker illustrated in the drawings is constructed so as to utilize the operative concepts or principles of the invention set forth and claimed in the appended claims. It will be realized that various structures coming within the scope of various of these claims can be constructed in various different manners utilizing what is considered to be routine skill within the loudspeaker industry. For this reason the invention is not to be considered as being limited to the precise structures shown in the drawing.

DETAILED DESCRIPTION

In FIG. 1 of the drawing there is shown a horn loudspeaker system or combination 10 in accordance with the present invention which is constructed so as to utilize a conventional or known speaker 12 including a conventional diaphragm 14. The speaker 12 has a projecting flange 16 extending generally around the diaphragm 14 which is used in mounting the speaker 12 in what is designated herein as a horn 18.

In a sense this horn 18 may be referred to as a housing or similar member. In the preferred construction of the present invention this horn 18 is composed of two identical sections 20, each of which is formed in a conventional manner of a rigid, porous, foam material 22 having a smooth, continuous exterior skin 24 such as, for example, a known rigid polyurethane composition. Such compositions are commonly utilized for packing various objects and other related purposes and are created by mixing two separate liquid ingredients which "foam" after they are mixed and which in time set up so as to form a structure as described.

These sections 20 are provided with flat contact surfaces 26 which are adapted to fit flat against one another and to be secured to one another by a conventional adhesive (not shown) so that in effect the horn 18 may be regarded as a continuous, unitary body. If desired, known types of interlocking means or expedients (not shown) can be used to assure that the surfaces are correctly aligned with one another. These sections 20 are formed so that when they are assembled into the horn 18 there is a small rear cavity 28 which accommodates the speaker 12 so that the flange 16 is located and is held within a continuous groove 30 in such a manner that the speaker 12 is supported by the horn 18. No portion of the horn 18 directly contacts the diaphragm 14.

Obviously the sections 20 may also be shaped in various known manners in connection with any cavity corresponding to the specific cavity 28 as hereinafter described so that the speaker 12 is mounted upon the horn 18 in virtually any desired manner. As an illustration of this, there is shown in FIG. 5 of the drawing part of a modified horn 34 in which the cavity 28 and the groove 30 are replaced by a small ring-like flange 36 so that a speaker 38 may be directly attached to a rear surface 40 in such a manner that a diaphragm 41 of the speaker 38 extends across the flange 36 without being physically engaged by this flange 36.

The sections 20 are also formed so that as they are assembled into the horn 18 they define what may be referred to as an internal horn cavity 32. The surfaces within this cavity 32 as hereinafter described may be referred to as sound directing surfaces since they tend to reflect sound during the operation of the complete horn loudspeaker system 10. These same surfaces also tend to absorb sound to a very limited degree or extent. It is considered that they (and adjacent materials) also tend to resonate to an extremely limited degree or extent during the use of the horn loudspeaker system 10 and that also to a very limited extent they transmit physical vibrations to the cellular material 22 within the sections 20. All of these actions are considered interrelated in various presently not completely understood manners to obtain the results achieved with the complete horn loudspeaker system 10.

It is considered beneficial to construct any known horn for use with any horn loudspeaker system having an internal cavity of a known shape somewhat corresponding to the cavity 28 utilizing the manner of construction indicated in the preceding discussion. Because the sections 20 can be easily and conveniently manufactured using relatively simple "straight pull" molds or dies without undercuts at a comparatively nominal cost, and because such sections may be easily and conveniently assembled together in the manner described, the type of construction indicated is beneficial. The mode of construction of the horn 18 is such that the physical properties of the material within the horn 18 as expressed in the physical action in response to sound of the cavity 28 is considered beneficial or desirable regardless of how the cavity 28 may be shaped.

This cavity 28 may be regarded as having a center line or axis 42 which is perpendicular to the center of the diaphragm 14. This cavity 28 is constructed in such a manner as to be bilaterally symmetrical with respect to two different planes (not separately identified) passing through the axis 42 at right angles to one another in directions which are perpendicular to the plane of the drawing.

In order to achieve what may be considered as preferred results in accordance with this invention regardless of the manner in which a speaker is mounted on a horn as described, it is preferred that the cavity 28 within the horn be shaped so as to include what may be termed a sound chamber or throat region 44, flare region 46, and a comparatively small transitional region 48 of essentially a line-like character extending between and connecting the regions 44 and 46. These regions 44, 46 and 48 are designated by these numerals at the bottoms of FIGS. 2 and 3 of the drawing in connection with lines corresponding to lengths of these regions along the length of the axis of the cavity 28.

The sound chamber region 44 may be regarded as having an entrance 50 located in a plane perpendicular to the axis 42 which is spaced as closely adjacent to the circular periphery (not separately numbered) of the diaphragm 14 as reasonably possible without touching this diaphragm 14. This sound chamber region 44 may be constructed so as to include a single, continuously curved wall 52 which is completely symmetrical about the axis 42 shaped so as to include a necked down restriction or throat 54 intermediate the entrance 50 and the transitional region 48.

It is important that the wall 52 does not include any sharp corners or edges since any such corners or edges would be apt to reflect sound waves in such a manner as to detract from the results achieved. The wall 52 may be bilaterally symmetrical about a plane extending through the axis 42. As hereinafter indicated the dimensions of the region 44 along the axis 42 are considered important in obtaining preferred results with the invention.

In order to achieve what are believed to be preferred results with the invention the flare region 46 should be constructed utilizing two spaced, opposed flat walls 60 which are located at an angle with respect to one another and which are located so that these walls, if extended, would meet along a line (not shown) which would extend perpendicular to the axis 42. The angle between the walls 60 is a matter of choice and may be referred to as a coverage angle since this angle relates to the extent to which sound will be spread across a space or area in front of the horn loudspeaker system 10. Normally these walls 60 will be located at an angle of from about 60 to about 90 degrees with respect to one another in accordance with the intended utilization of the horn loudspeaker system 10.

Also the flare region 46 includes two opposed walls 62 which are curved with a gradual, continued, smooth curvature and which extend between the flat walls 60 so as to also diverge outwardly from the sound cavity region. These walls 62 are preferably shaped so as to have a gradually increasing curvature which increases in accordance with the distance from the sound cavity region 44.

The transitional region 48 is not so much a region as essentially a line or line-like area which serves to blend the configuration of the adjacent ends (not separately numbered) of the sound chamber region 44 with the flare region 46—in a comparatively rapid, smooth, curved manner along a distance which is as short as reasonably possible in the general direction of the axis 42. This transitional region 48 is designed to provide a transition between the two regions 44 and 46 which is as small as reasonably possible so as to minimize the chances of the transitional region 48 materially reflecting sound.

It is considered extremely important in obtaining preferred results in accordance with the present invention that the cross-sectional areas within the regions 44, 48 and 46 in imaginary planes perpendicular to the axis 42 undergo a continuous change in accordance with the distance from the throat 54 within the sound cavity region 44. In obtaining such results, such cross-sectional areas should gradually and continuously decrease in accordance with distance from the diaphragm 14 so as to be at a minimum at the portion of the throat 54 of smallest diameter and then should increase so that the cross-sectional area of the region 46 where sound is disseminated outwardly from the horn loudspeaker system 10 is larger than the cross-sectional area in any other imaginary plane perpendicular to the axis 42.

The use of such gradually changing areas throughout the length of the cavity 28 is considered to be advantageous because of a minimization of what may be referred to as standing sound waves and because of what may be referred to as a degree of control of the manner in which sound is reflected and directed within the horn loudspeaker system 10. The throat 54 is considered quite important in this regard in that it intends to produce what may be referred to as an acoustical load upon the diaphragm 14. The amount of such acoustical load will, of course, be related to the relative diameter of the diaphragm 14 and the throat 54.

These considerations are exceedingly complex in character and are made even more complex because any horn loudspeaker system 10 should produce sound which is considered acceptable or desirable by many individuals. It is well known that there is a great deal of variation in the way individuals hear sound.

As a result of experimentation it is believed that the preferred results are achieved when the variation of areas along the axis 42 of the cavity 28 is related in accordance with either of two different formulas. The first of these is:

$$S_1 = S_0 e^{m|x|}$$

The second of these is:

$$S_1 = S_0(\sin h|x| + \cos h|x|)^2$$

In both of these formulas "$S_0$" is the cross-sectional area in a plane perpendicular to the axis 42 at the portion of the throat 54 of smallest diameter. In both of these formulas "$S_1$" is the cross-sectional area in such a plane perpendicular to the axis 42 at any particular distance from the area of the throat 54 of smallest cross-sectional area. In both of these formulas "x" is the latter distance along the axis 42. The value of "x" will equal a real positive number and will denote the distance from the area 54 of least cross-sectional area to either the diaphragm 14 or horn mouth area 46. In the first of these formulas "m" is a real number which may be referred to as a flare constant, and "e" is a constant, preferably the base of the natural system of logarithms. In the second of these formulas, "T" is a real number reasonably corresponding to "m" which may be varied in achieving any desired appearance or in accommodating structural requirements.

In a preferred horn loudspeaker system 10 in accordance with this invention either of these formulas may be utilized in determining the cross-sectional areas noted in either of the regions 44 or 46. Thus, the cross-sectional areas in the regions 44 and 46 may be both determined using the first formula or the second formula, or the areas within these regions 44 and 46 may be determined using one formula for the areas within one region and the other formula for the areas within the other region.

The area within the transitional region 48 must always be related to the adjacent areas within the regions 44 and 46 in obtaining preferred results in the sense that there must be a gradual, continuous "smooth" change in area in imaginary planes perpendicular to the axis 42 throughout this region 48 such as to accomplish a rapid accommodation to the changes in cross-sectional configurations of the regions 44 and 46 in such a manner as to minimize any possibility of the region 48 tending to reflect sound to any significant extent. Because of the geometry of the region 48 in accommodating a gradual change in cross-sectional configuration, there is a danger that if this transitional region was of greater length than necessary to accommodate the change in geometry while concurrently providing for a continuous change in cross-sectional area, that this transitional area would undesirably effect the quality of sound achieved.

The lengths of the regions 44 and 46 can be varied to significant extents in achieving preferred results in accordance with the present invention, and similarly the ratio of the area at the throat 54 to the area of the diaphragm 14 can be varied to a significant extent. Such variation in the ratio of these two areas and in these lengths is considered to involve what may be referred to as continuous variable type considerations inasmuch as no sharp or distinctly different results are achieved within reasonable limits of variations such as are apt to be encountered in designing the cavity 28.

It is considered, however, that normally the cross-sectional area of the throat 54 should be less than 100 percent of the cross-sectional area of the diaphragm 14 in order to achieve acoustic loading of the diaphragm 14 and in order to otherwise achieve satisfactory results. Presently it is considered that preferred results are achieved if this area of the throat 54 is no greater than 95 percent of the area of the diaphragm 14. Also, in achieving preferred results, it is considered that the length of the sound chamber region 44 should be such that the distance from the throat 54 to the transitional region 48 should be at least as great as the distance from the throat 54 to the diaphragm 14. The length along the axis 42 of the flare region 46 is essentially a matter of choice. It is presently considered that in general best results are achieved when this flare region 46 is at least as long as the sound chamber region 44.

It is noted that in the construction shown the precise cross-sectional configuration of the sound chamber region 44 between the throat 54 and the transition region 48 is shaped in a manner which is difficult to verbally express. In this portion of the region 46 the shape is determined by two factors: (1) a maintenance of the area relationships described as determined by the formulas given; and (2) a gradual change in configuration necessary to "blend" surface shapes from a round cross-sectional shape at the throat 54 to a shape at the transitional region 48 which closely approximates the shape of the adjacent portion of the flare region 46 so as to minimize the variation from a "smooth" curvature at the transitional region 48 to as great a degree as reasonably possible.

It is emphasized that the values given in the preceding are not fixed or absolute values based upon precise numerical data, but instead are values derived from experience and essentially empirical results such as from listening to a horn loudspeaker 10 in accordance with this invention. Results closely approximating those achieved by constructing the two regions 44 and 46 in accordance with the formula noted can be achieved by modifying the shapes of these regions 44 and 46 so that they bear a reasonable or substantial resemblance to the regions 44 and 46 specifically described.

The action achieved with the region 44 shaped as indicated is not completely understood. The region 44 shaped as indicated is considered desirable as minimizing the presence of what may be referred to as standing sound waves, particularly between the throat 54 and the diaphragm 14. The throat 54 exercises a pinch-type effect so as to create what may be referred to as an acoustical load upon the diaphragm 14 in such a manner as to tend to improve performance characteristics. The entire sound chamber region 44 acts as a wave guide and not only constricts the sound waves produced at the diaphragm 14, but tends to "blend " these sound waves and then to release them as they pass into the flare region 44 where they are effectively "controlled" in such a manner that they pass to the ambient air in such a manner as to achieve what was referred to in the preceding as clarity.

We claim:

1. A horn loudspeaker system including a speaker having a diaphragm and a horn provided with an internal horn cavity, said cavity having an entrance and an exit, said horn being located so that said diaphragm is positioned so as to extend across said entrance to said cavity and so that said horn cavity extends outwardly away from said diaphragm in which the improvement comprises:

said horn cavity having a centrally located axis which is perpendicular to the center of said diaphragm and being bilaterally symmetrical about a plane passing through said axis, said horn cavity including a sound chamber region, a transitional region, and a flare region located so that said sound chamber region extends from said entrance toward the interior of said cavity and so that said flare region extends from within the interior of said cavity to said exit, said sound chamber and flare regions being separated by said transitional region, said sound chamber region including a throat extending transverse to said axis intermediate the ends thereof which is of lesser cross-sectional area than any other part of said sound chamber region and being defined by at least one wall having a continuous, smooth curvature extending between the ends of said sound chamber region, said flare region being defined by two substantially flat walls located at an angle with respect to one another and two curved walls extending between said flat walls, said walls of said flare region diverging outwardly away from said sound chamber region, said curved walls of said flare region having a gradually increasing curvature in accordance with the distance from said sound chamber region, said transitional region being shaped so as to provide a substantially smooth transition between the adjacent ends of said sound chamber region and said flare region.

2. A horn loudspeaker system as claimed in claim 1 wherein:

the walls within said cavity are shaped so that the cross-sectional areas within said cavity continuously increase in planes transverse to said axis in accordance with the distances within said cavity from said throat.

3. A horn loudspeaker system as claimed in claim 1 wherein:

the cross-sectional area along said axis in said sound chamber region are determined by either of the following formulas:

$$S_1 = S_0 e^{m|x|}$$

$$S_1 = S_0(\sin h|x| + T \cos h|x|)^2$$

in which $S_0$ is the cross-sectional area in a plane perpendicular to said axis at the portion of said throat of smallest diameter, x is the distance along said axis from the portion of said throat of smallest diameter, $S_1$ is the cross-sectional area in a plane perpendicular to said axis at any particular value of x, m is a real number, e is the base of the natural system of logarithms, and t is a real number, and the cross-sectional areas along said axis in said flare region are determined by either of said formulas.

4. A horn loudspeaker system as claimed in claims 1, 2 or 3 wherein:

the cross-sectional area of said throat is less than 100 percent of the cross-sectional area of said diaphragm, the length of said sound chamber region is such that the distance along said axis from said throat to said transitional region is at least as great as the distance along said axis from said throat to said diaphragm, the length of said flare region along said axis is at least as long as said sound chamber region.

5. A horn loudspeaker system as claimed in claims 1, 2 or 3 wherein:

said horn is formed as a unitary body of a porous, foam material having a smooth continuous exterior skin.

6. A horn loudspeaker system as claimed in claim 5 wherein:

said body is a rigid body formed of a polyurethane foam, and said body consists of sections which are adhered to one another.

7. A horn loudspeaker system as claimed in claim 1 wherein:

the cross-sectional areas along said axis in said sound chamber region are determined by either of the following formulas:

$$S_1 = S_0 e^{m|x|}$$

$$S_1 = S^0(\sin h|x| + T \cos h|x|)^2$$

in which $S_0$ is the cross-sectional area in a plane perpendicular to said axis at the portion of said throat of smallest diameter, x is the distance along said axis from the portion of said throat of smallest diameter, $S_1$ is the cross-sectional area in a plane perpendicular to said axis at any particular value of x, m is a real number, e is the base of the natural system of logarithms, and t is a real number, and the cross-sectional areas along said axis in said flare region are determined by either of said formulas, the cross-sectional area of said throat is less than 100 percent of the cross-sectional area of said diaphragm, the length of said sound chamber region is such that the distance along said axis from said throat to said transitional region is at least as great as the distance along said axis from said throat to said diaphragm, the length of said flare region along said axis is at least as long as said sound chamber region, and said body is a rigid body consisting of sections of a rigid, porous polyurethane foam material each of which has a smooth continuous exterior skin, said sections being adhered to one another.

8. A horn loudspeaker system as claimed in claim 7 wherein:

said speaker has an annular flange extending therearound, said sections include an annular groove which fits around and engages said flange so as to hold said speaker relative to said horn.

* * * * *

UNITED STATES PATENT AND TRADEMARK OFFICE

CERTIFICATE OF CORRECTION

PATENT NO. : 4,369,857

DATED : JANUARY 25, 1983

INVENTOR(S) : FRASER ET AL.

It is certified that error appears in the above-identified patent and that said Letters Patent is hereby corrected as shown below:

IN THE SPECIFICATION

Column 6, line 64, should read:

-- $S_1 = S_o \ (\text{Sinh} \ |mx| + T \cosh |mx|)^2$ --

IN THE CLAIMS

Column 9, line 34 and Column 10, line 23 should read:

-- $S_1 = S_o \ (\text{Sinh} \ |mx| + T \cosh |mx|)^2$ --

Column 9, lines 36 through 43; and Column 10, lines 25 through 32, should be amended to read:

in which $S_o$ is the cross-sectional area in a plane perpendicular to said axis at the portion of said throat of smallest diameter, x is the distance along said axis from the portion of said throat of smallest diameter, $S_1$ is the cross-

UNITED STATES PATENT AND TRADEMARK OFFICE

CERTIFICATE OF CORRECTION

PATENT NO. : 4,369,857

DATED : JANUARY 25, 1983

INVENTOR(S) : FRASER ET AL.

It is certified that error appears in the above-identified patent and that said Letters Patent is hereby corrected as shown below:

sectional area in a plane perpendicular to said axis at any particular value of x, m is a real number, e is the base of the natural system of logarithms, and [t] T is a real number, Signed and Sealed this

*Twenty-first* Day of *January 1986*

[SEAL]

*Attest:*

DONALD J. QUIGG

*Attesting Officer*

*Commissioner of Patents and Trademarks*